US006659156B2

(12) United States Patent
Wen et al.

(10) Patent No.: US 6,659,156 B2
(45) Date of Patent: Dec. 9, 2003

(54) SCREW TRANSMISSION MECHANISM FOR A BLIND

(75) Inventors: Yu-Che Wen, Taoyuan (TW); Song-He Lui, Kaohsiung (TW)

(73) Assignees: Industrial Technology Research Institute, Hsinchu Hsien (TW); Nien Made Enterprise Co., Ltd., Changhua Hsien (TW)

( * ) Notice: Subject to any disclaimer, the term of this patent is extended or adjusted under 35 U.S.C. 154(b) by 0 days.

(21) Appl. No.: 10/157,228

(22) Filed: May 30, 2002

(65) Prior Publication Data

US 2003/0168188 A1 Sep. 11, 2003

(30) Foreign Application Priority Data

Mar. 7, 2002 (TW) ..... 91202678 U

(51) Int. Cl.[7] ..... E06B 9/30

(52) U.S. Cl. ..... 160/168.1 P; 160/171 R; 160/DIG. 17

(58) Field of Search ..... 160/168.1 P, 170 R, 160/176.1 P, 171 R, 295, 310, DIG. 17

(56) References Cited

U.S. PATENT DOCUMENTS

| | | | | | |
|---|---|---|---|---|---|
| 2,250,106 | A | * | 7/1941 | Lorentzen | 160/171 R |
| 2,758,644 | A | * | 8/1956 | Virlouvet | 160/170 R |
| 3,310,099 | A | * | 3/1967 | Hunter et al. | 160/171 R |
| 3,603,372 | A | * | 9/1971 | Dietzsch | 160/168.1 P |
| 3,809,143 | A | * | 5/1974 | Ipekgil | 160/168.1 P |
| 4,096,903 | A | * | 6/1978 | Ringle | 160/168.1 P |
| 5,103,888 | A | | 4/1992 | Nakamura | |
| 5,228,491 | A | * | 7/1993 | Rude et al. | 160/171 R |

* cited by examiner

*Primary Examiner*—David Purol
(74) *Attorney, Agent, or Firm*—Browdy and Neimark, P.L.L.C.

(57) ABSTRACT

A screw transmission mechanism for a motor-driven blind is constructed to include a driving unit, and at least one cord roll-up unit controlled by the driving unit to lift/lower or tilt the slats of the motor-driven Venetian blind. Each cord roll-up unit includes an amplitude modulation set controlled by the driving unit to lift/lower the slats and bottom rail of the Venetian blind, a frequency modulation set for rotation with the amplitude modulation set to tilt the slats of the Venetian blind, and a linkage adapted to control connection between the frequency modulation set and the amplitude modulation set.

15 Claims, 9 Drawing Sheets

SCREW TRANSMISSION MECHANISM FOR A BLIND

BACKGROUND OF THE INVENTION

1. Field of the Invention

The present invention relates to Venetian blinds and, more specifically, to a screw transmission mechanism for a motor-driven blind.

2. Description of the Related Art

A regular Venetian blind comprises headrail, a bottom rail, a plurality of slats arranged in parallel between the headrail and the bottom rail, an amplitude modulation control mechanism for controlling lifting and positioning of the bottom rail to change the extending area of the blind, a frequency modulation control mechanism for controlling the tilting angle of the slats to regulate the light. The amplitude modulation control mechanism comprises an endless lift cord suspended from the headrail at one lateral side for pulling by hand to lift/lower the bottom rail. The frequency modulation control mechanism comprises a frequency modulation member disposed at one lateral side of the blind for permitting rotation by the user to regulate the tilting angle of the slats. When adjusting the elevation of the bottom rail, the user must approach the blind and pull the lift cord by hand with much effort. Further, because the lift cord is not kept out of reach of children, children may pull the lift cord for fun. In case the lift cord is hung on a child's head, a fetal accident may occur.

U.S. Pat. No. 5,103,888 discloses a motor-driven blind, which keeps the lift cord from sight. According to this design, a motor is mounted in the headrail or bottom rail, and controlled by a remote controller to roll up or let off the lift cord. The motor is used to control lifting of the lift cord only. When adjusting the tilting angle of the slats, the user must approach the blind and touch-control a tilting control unit. This operation manner is still not convenient.

SUMMARY OF THE INVENTION

The present invention has been accomplished to provide a screw transmission mechanism for a motor-driven blind, which eliminates the aforesaid drawbacks. It is the main object of the present invention to provide a screw transmission mechanism for a motor-driven blind, which controls lifting/lowering of the slats and bottom rail of the Venetian blind as well as tilting of the slats. It is another object of the present invention to provide a screw transmission mechanism for a motor-driven blind, which is compact, and requires less installation space. It is still another object of the present invention to provide a screw transmission mechanism for a motor-driven blind, which is inexpensive to manufacture. To achieve these objects of the present invention, the screw transmission mechanism is installed in a motor-driven Venetian blind and adapted to lift/lower the slats and bottom rail of the Venetian blind and to tilt the slats, comprising at least one cord roll-up unit and a driving unit adapted to drive the at least one cord roll-up unit. Each cord roll-up unit comprises: an amplitude modulation set, the amplitude modulation set comprising a support, an amplitude modulation lift cord connected to the slats and bottom rail of the Venetian blind and adapted to lift/lower the slats and bottom rail of the Venetian blind, and an amplitude modulation wheel threaded into the support and coupled to the driving unit for free rotation and axial movement relative to the support to roll up/let off the amplitude modulation lift cord upon operation of the driving unit, the amplitude modulation wheel comprising a longitudinal groove; a frequency modulation set, the frequency modulation set comprising a frequency modulation lift cord adapted to tilt the slats of the Venetian blind, and a frequency modulation wheel sleeved onto the amplitude modulation wheel and adapted to roll up/let off the frequency modulation lift cord, the frequency modulation wheel comprising a notch; and a linkage, the linkage comprising a link mounted in the groove of the amplitude modulation wheel and the notch of the frequency modulation wheel to couple the frequency modulation wheel to the amplitude modulation wheel for synchronous rotation, and a stop block adapted to limit the angle of rotation of the frequency modulation wheel and to force the link away from the frequency modulation wheel when the amplitude modulation wheel rotated to a predetermined position.

DETAILED DESCRIPTION OF THE PREFERRED EMBODIMENT

Figure 1:
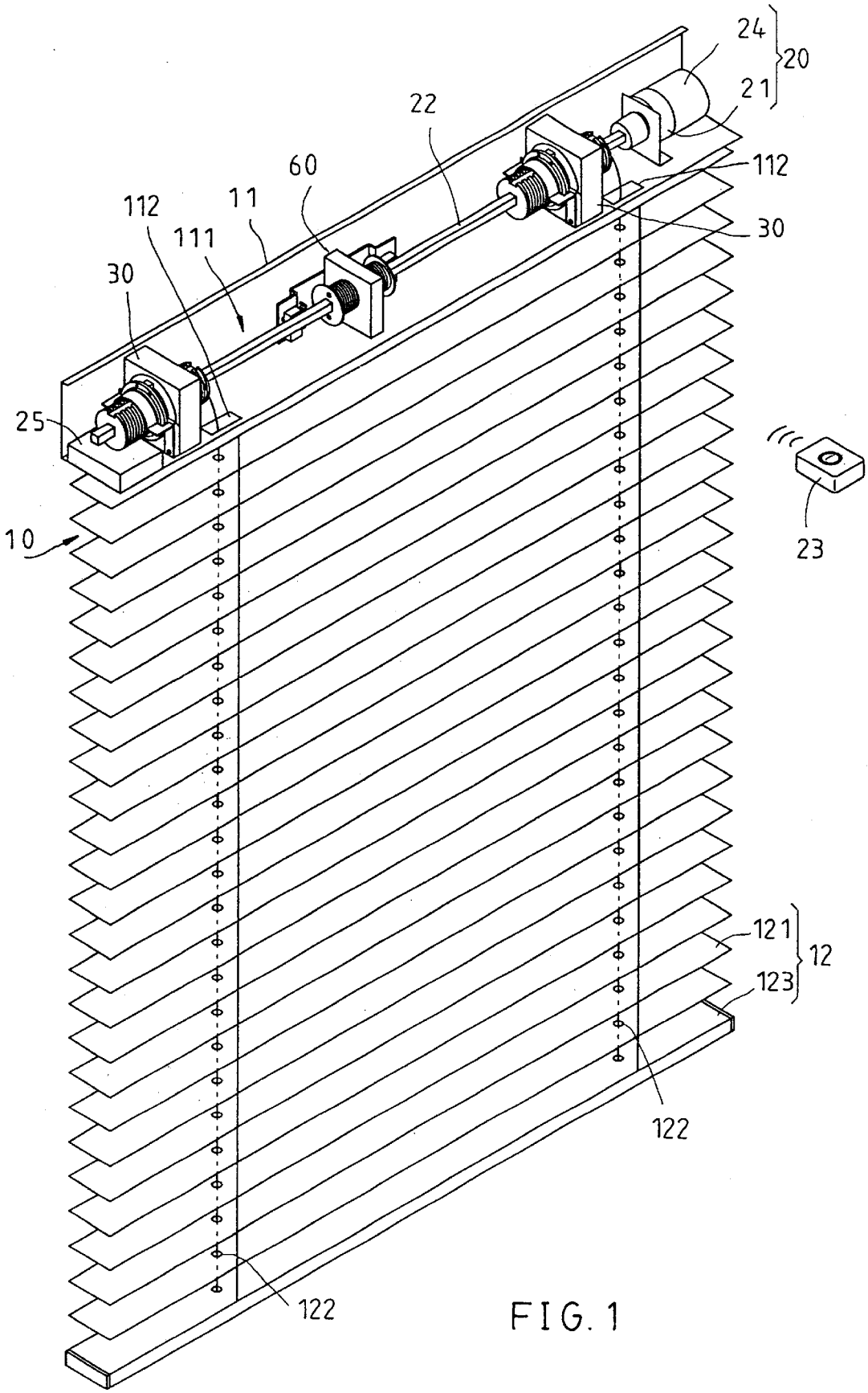
FIG. 1 is an applied view of the present invention, showing the screw transmission mechanism installed in a Venetian blind.
Figure 2:
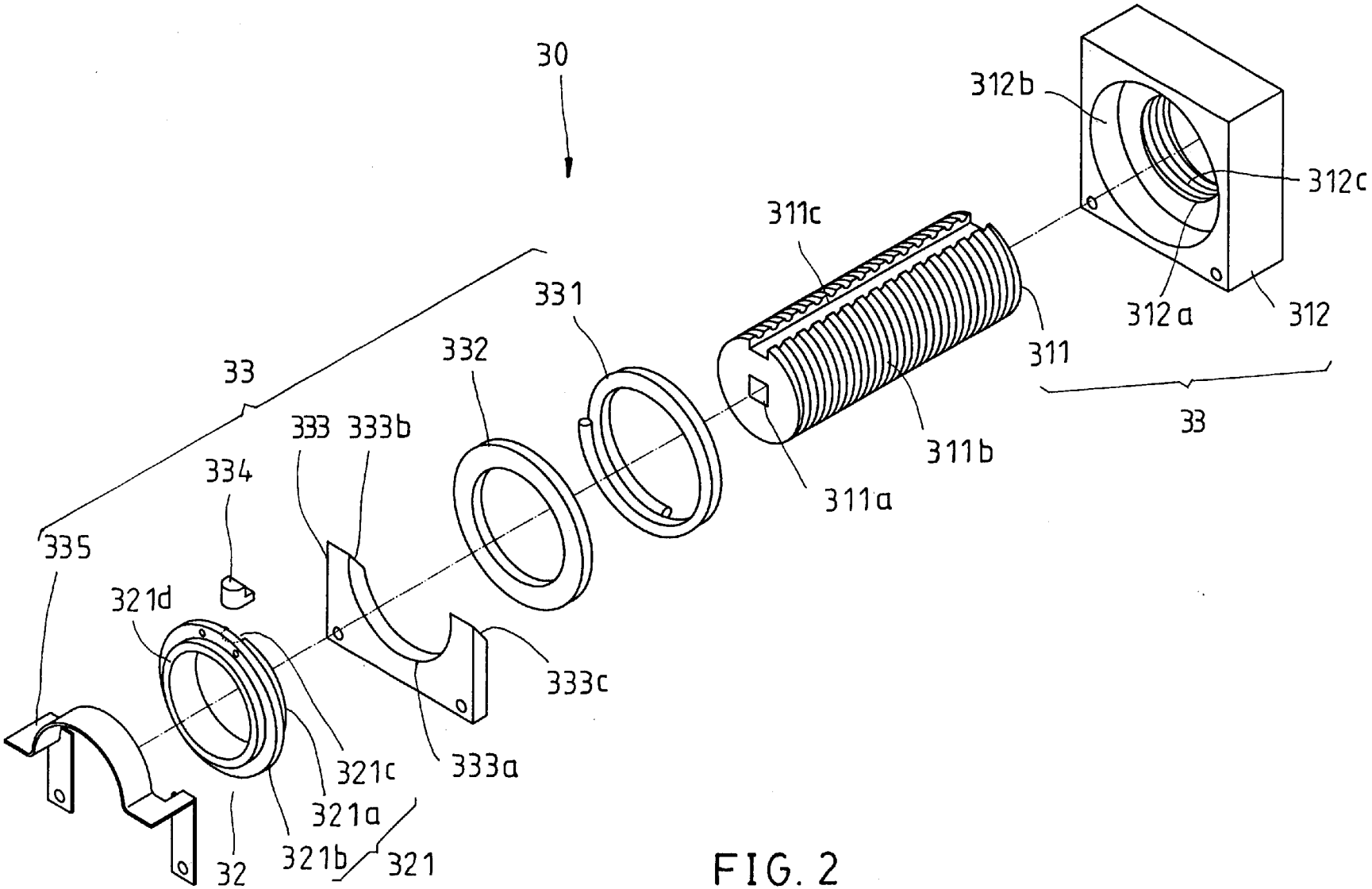
FIG. 2 is an exploded view of the cord roll-up unit for the screw transmission mechanism according to the present invention.

Referring to FIGS. From 1 through 4, the present invention provides a screw transmission mechanism 100 mountable to a Venetian blind 10. The Venetian blind 10, as shown in FIG. 1, comprises a headrail 11 and a slat set 12. The headrail 11 is mountable to the top side of the window, comprising, an inside holding chamber 111, and two through holes 112 bilaterally disposed at a bottom side in communication with the holding chamber 111. The slat set 12 is comprised of a plurality of slats 121 and a bottom rail 123. Each slat 121 has two-wire holes 122 corresponding to the through holes 112 of the headrail 11. Because the Venetian blind 10 is of the known art, no further detailed structural description is necessary. The screw transmission mechanism 100 comprises a driving unit 20 and two cord roll-up units 30.

As shown in FIG. 1, the driving unit 20 comprises a reversible motor 21, a transmission shaft 22, a signal transmitter 23, a signal receiver 24, and a battery 25. The motor 21 is mounted inside the holding chamber 111 of the headrail 11. The transmission shaft 22 is a non-circular rod member, having one end coupled to the motor 21 for rotation by the motor 21. The signal transmitter 23 can be a remote controller or wired controller for providing control signal to the signal receiver 24. According to the present preferred embodiment, the signal transmitter 23 is a radio transmitter. The signal receiver 24 is electrically connected to the motor 21, and adapted to control the operation of the motor 21 subject to the nature of the control signal received from the signal transmitter 23. The battery 25 can be storage battery, dry battery, planar battery, cylindrical battery, or mercury battery mounted inside of the holding chamber 111 and electrically connected to the motor 21 to provide the motor 21 with the necessary working power.

Referring to FIGS. From 2 through 4, the cord roll-up units 30 are respectively mounted inside the holding chamber 111 of the headrail 11 corresponding to the through holes 112. each comprised of an amplitude modulation set 31, a frequency modulation set 32, and a linkage 33.

Figure 3:
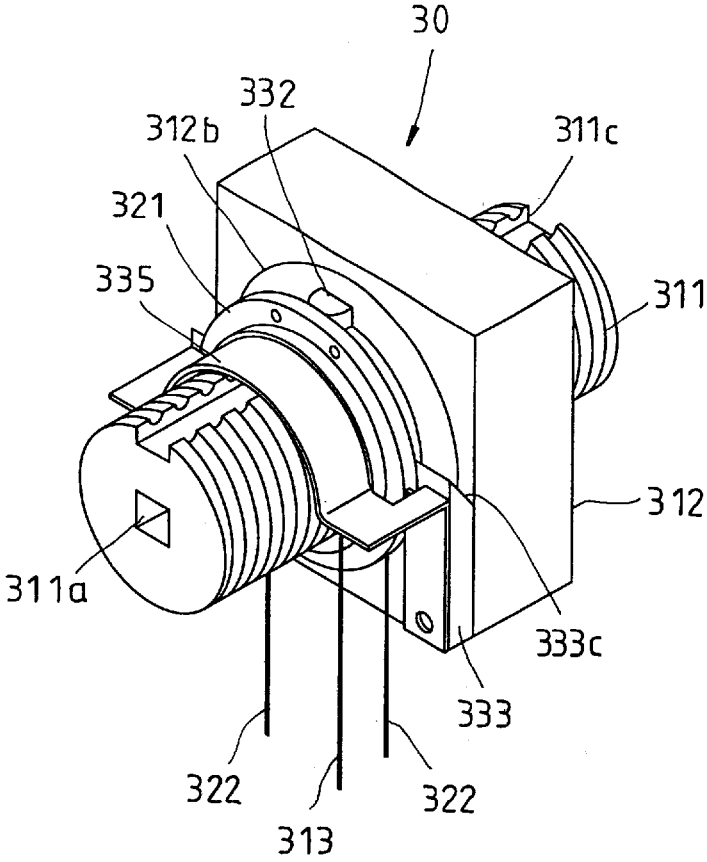
FIG. 3 is an elevational assembly view of the cord roll-up unit shown in FIG. 2.

The amplitude modulation set 31 comprises an amplitude modulation wheel 311, a support 312, and an amplitude modulation lift cord 313. The amplitude modulation wheel 311 is a cylindrical wheel, comprising an axially extended center through hole 311*a* for accommodating the transmission shaft 22 of the driving unit 20, the center through hole 311*a* having a cross section fitting the cross section of the transmission shaft 22, an outer thread 311*b* extended around the periphery, and a longitudinal groove 311*c* longitudinally disposed in the periphery and extended to the two distal ends across the outer thread 311*b*. The support 312 is fixedly mounted inside the holding chamber 111 of the headrail 11, having a stepped center through hole formed of a through hole 312*a* and a recessed hole 312*b*, and inner threads 312*c* extended around the center through hole 312*a*. The inner diameter of the through hole 312*a* is smaller than the recessed hole 312*b* but approximately equal to the outer diameter of the amplitude modulation wheel 311. The inner thread 312*c* is threaded onto the outer thread 311*b* of the amplitude modulation wheel 311. As illustrated in FIG. 3, the amplitude modulation lift cord 313 has one end fixedly connected to the amplitude modulation wheel 311, and the other end inserted through one through hole 112 of the headrail 11 and one wire hole 122 of each slat 121 and then fixedly connected to the bottom rail 123.

The frequency modulation set 32 is comprised of a frequency modulation wheel 321, and a frequency modulation lift cord 322. The frequency modulation wheel 321; comprises an axially extended circular hole 321*d*, a body 321*a* and a head 321*b* disposed around the periphery. The body 321*a* is provided with a notch 321*c*. The outer diameter of the head 321*b* is greater than the outer diameter of the body 321*a*. The frequency modulation lift cord 322 has one end fixedly connected to the frequency modulation wheel 321, and the other end inserted through one through hole 112 of the headrail 11 and fixedly connected to each slat 121 and the bottom rail 123.

The linkage 33 comprises a spring 331, a pressure ring 332, a stop block 333, a link 334, and a limiter 335. The spring 331 is sleeved onto the amplitude modulation wheel 311 and inserted into the recessed hole 312*b* of the support 312, having one end supported on the inside wall of the support 312 between the recessed hole 312*b* and the through hole 312*a*. The pressure ring 332 is sleeved onto the amplitude modulation wheel 311 and stopped at the other end of the spring 331. The stop block 333 is fixedly fastened to the support 312 at the outside of the recessed hole 312*b* and stopped at the opposite side of the pressure ring 332 against the spring 331, having a semi-circular notch 333*a*, and two beveled faces 332*b*; 332*c* disposed at two sides of the semi-circular notch 333*a* and respectively downwardly sloping from the top toward the recessed hole 312*b*. The link 334 is a L-shaped key inserted into the groove 311*c* of the amplitude modulation wheel 311. The frequency modulation wheel 321 is sleeved with its circular hole 321*d* onto the amplitude modulation wheel 311. The link 334 has one part inserted into the notch 321*c* and another part inserted into the groove 311*c* of the amplitude modulation wheel 311, enabling the amplitude modulation wheel 311 and the frequency modulation wheel 321 to be linked to each other by the link 334. The limiter 335 is fixedly fastened to the support 312, stopping the frequency modulation wheel 321 from falling out of the amplitude modulation wheel 311.

The operation of the present invention is outlined hereinafter with reference to FIGS. from 5 through 8, when the user operated the signal transmitter 23 of the driving unit 20 to transmit a control signal of lifting the Venetian blind, the signal receiver 24 immediately receives the signal. Upon receipt of the signal, the signal receiver 24 drives the motor 21 to rotate the transmission shaft 22. Because the center through hole 311*a* of the amplitude modulation wheel 311 is a non-circular hole that fits the transmission shaft 22, rotating the transmission shaft 22 causes the amplitude modulation wheel 311 to be synchronously rotated to roll up the amplitude modulation lift cord 313, as shown in FIGS. from 12 through 14. During rotary motion, the amplitude modulation wheel 311 moves axially in the support 312, keeping the amplitude modulation lift cord 313 to be smoothly wound round the amplitude modulation wheel 311. When the amplitude modulation wheel 311 rolling up the amplitude modulation lift cord 313, the bottom rail 123 is lifted, thereby causing the slats 121 to be received and moved with the bottom rail 123 upwards toward the headrail 11 to the desired elevation.

Figure 4:
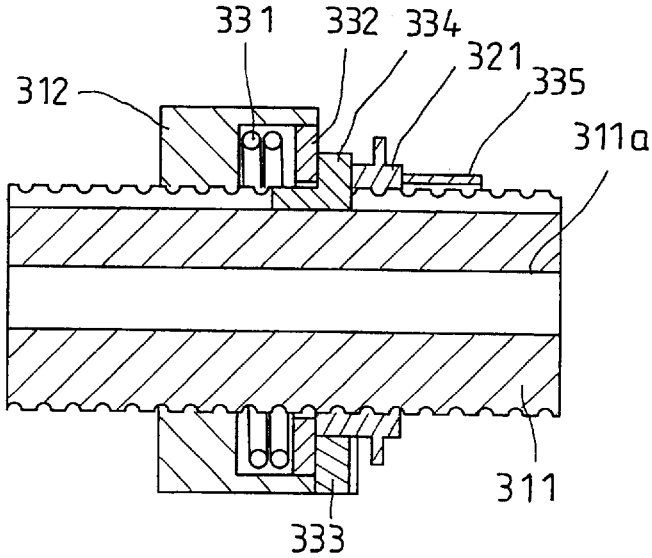
FIG. 4 is a sectional view of the cord roll-up unit shown in FIG. 3.
Figure 5:
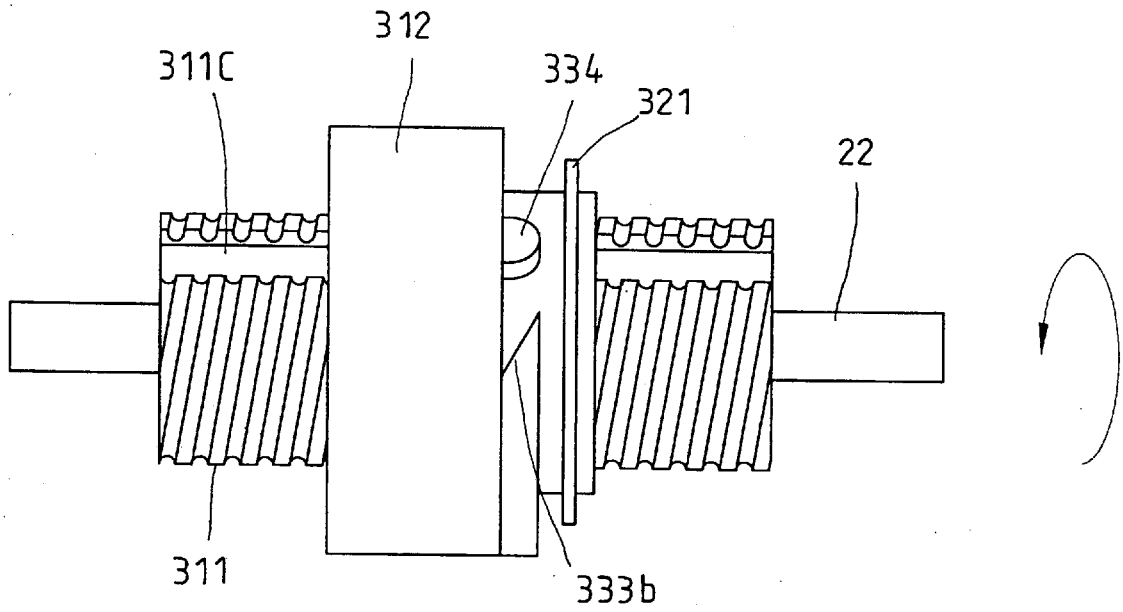
FIGS. 5~8 are side views showing continuous action of the amplitude modulation set and the frequency modulation set according to the present invention.
Figure 6:
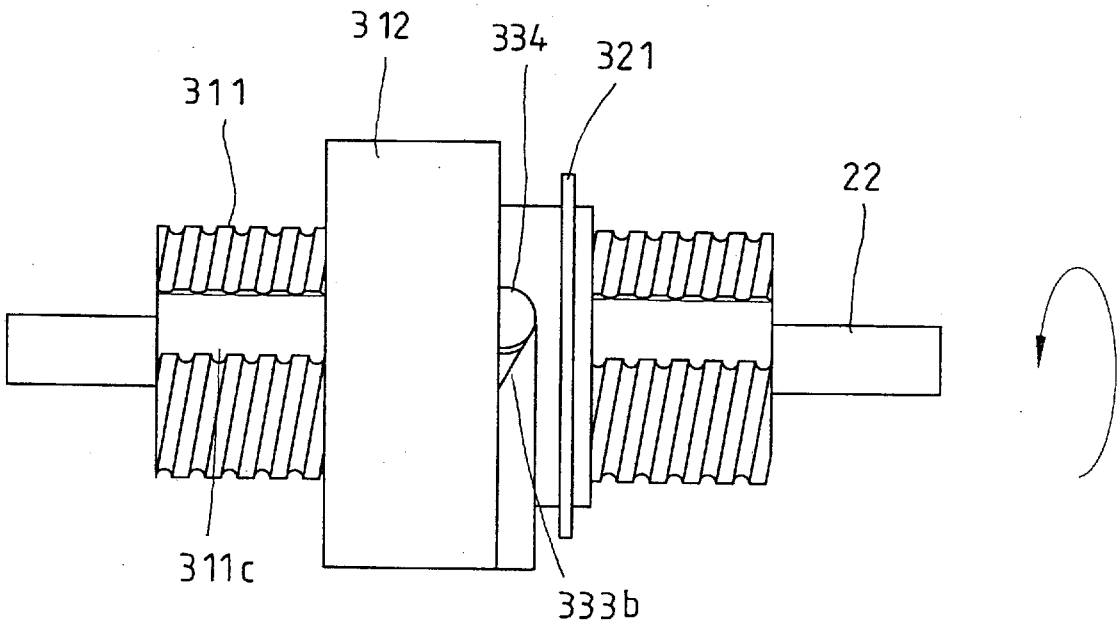
Figure 7:
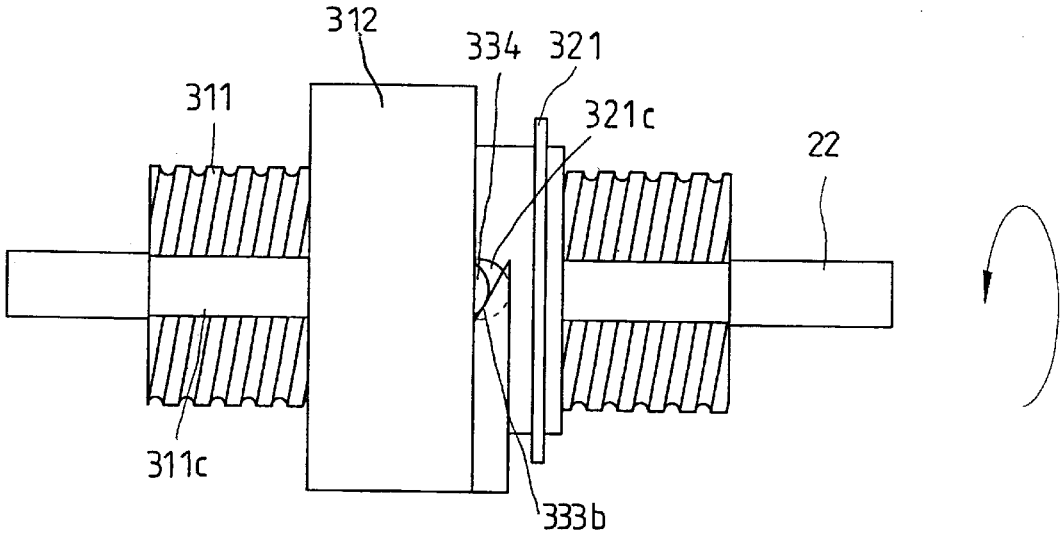
Figure 8:
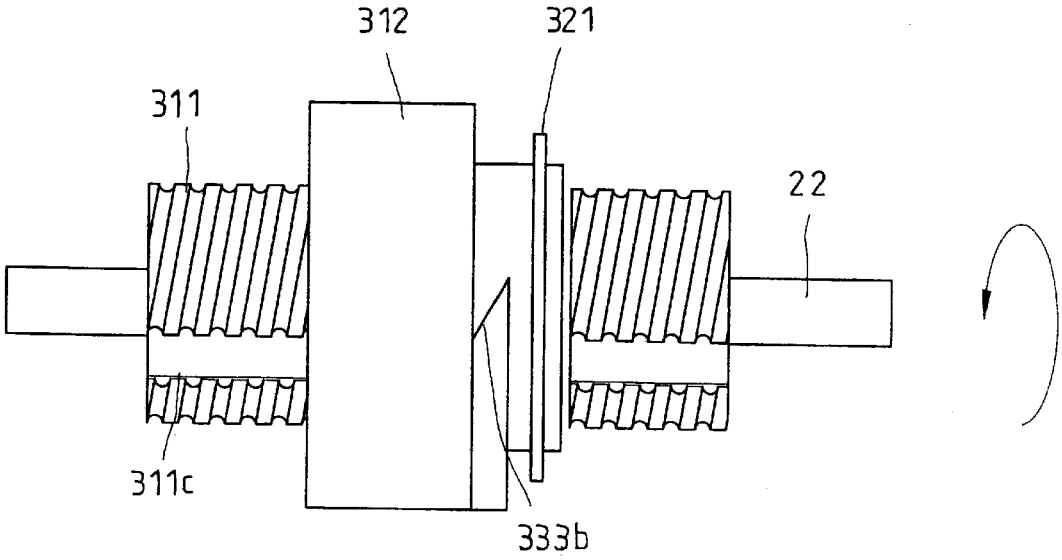
Figure 9:
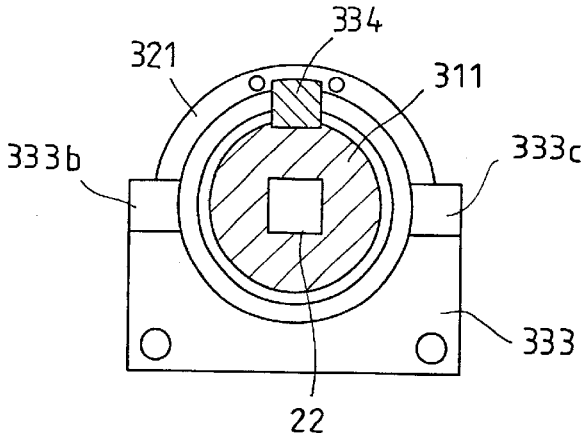
FIGS. 9~11 are sectional views showing the action of the amplitude modulation set and the frequency modulation set according to the present invention.
Figure 10:
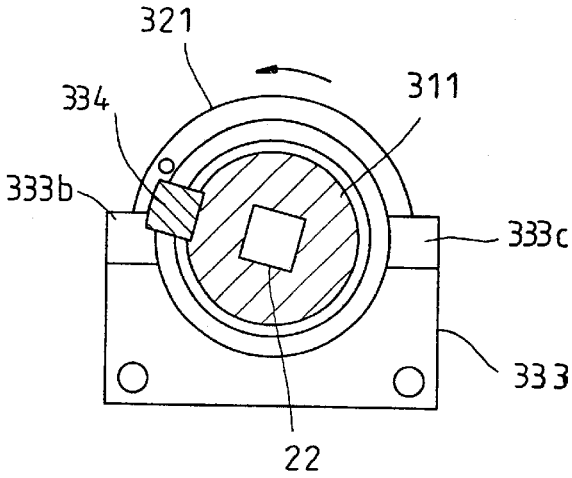

Because the linkage 33 links the frequency modulation wheel 321 and the amplitude modulation wheel 311, the frequency modulation wheel 321 is rotated with the amplitude modulation wheel 311 at this time, as shown in FIGS. 5 and 6 and FIGS. 9 and 10. During rotary motion of the frequency modulation wheel 321, the frequency modulation lift cord 322 is moved, causing the slats 121 to be tilted. When the frequency modulation wheel 321 turned to a predetermined position (the position where the link 334 touches the beveled face 333*b* of the stop block 333), as shown in FIGS. 4, 7, and 8, the link 334 moves along the beveled face 333*b* toward the recessed hole 312*b* to push the pressure ring 332 against the spring 331 and to compress the spring 331, enabling the link 334 to be forced out of the notch 321*c* of the frequency modulation wheel 321 to disconnect the frequency modulation wheel 321 from the amplitude modulation wheel 311. Therefore, when the frequency modulation wheel 321 rotated to this angle, it is disengaged from the amplitude modulation wheel 311. At this time, the transmission shaft 22 continuously rotates the amplitude modulation wheel 311 to roll up the amplitude modulation lift cord 313 and to receive the slats 121 without changing the tilting angle of the slats 121.

Figure 11:
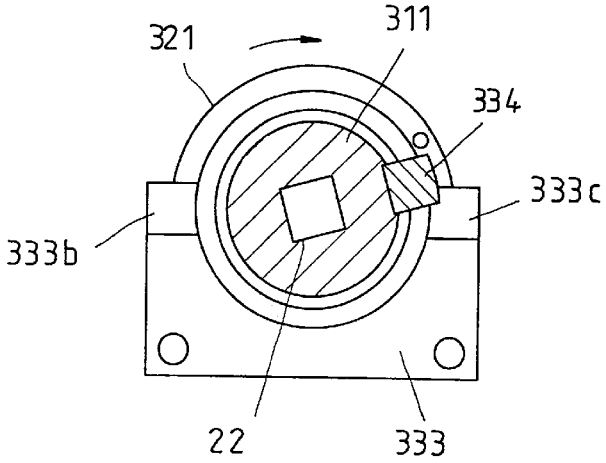
Figure 12:
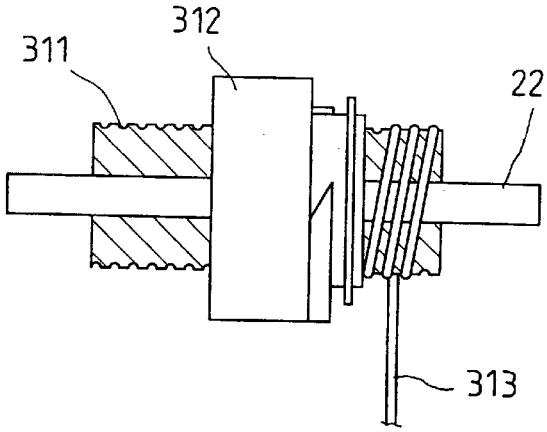
FIGS. 12~14 are schematic drawings showing lift cord rolling up action of the amplitude modulation set according to the present invention.
Figure 13:
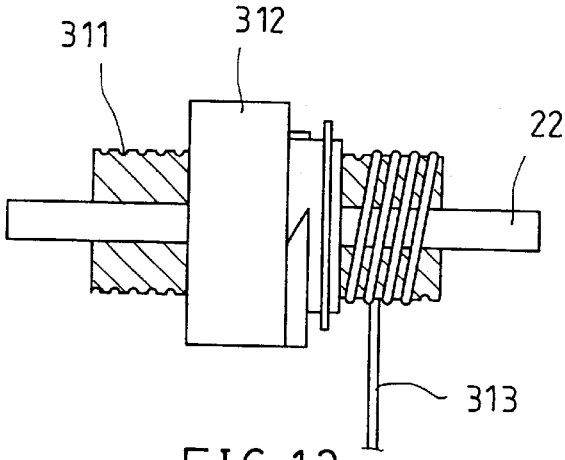
Figure 14:
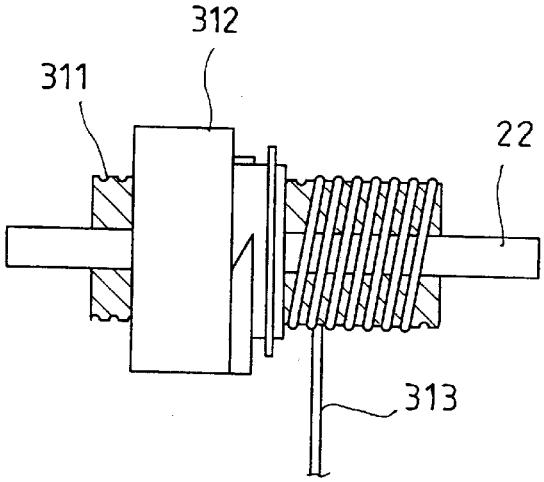

When releasing the slats 121, operates the signal transmitter 23 to transmit a control signal of releasing the slats to the signal receiver 24. Upon receipt of the signal, the signal receiver 24 immediately drives the motor 21 to rotate in the reversed direction, thereby causing the transmission shaft 22 and the amplitude modulation wheel 311 to be rotated in the same direction. Reverse rotation of the amplitude modulation wheel 311 lets off the amplitude modulation lift cord 313, and therefore the bottom rail 123 and the slats 121 are lowered to extend out the Venetian blind 10. At the initial stage during rotary motion of the amplitude modulation wheel 311, the beveled face 333*b* of the stop block 333 keeps the frequency modulation wheel 321, out of the amplitude modulation wheel 311. However, when the link 334 moved with the amplitude modulation wheel 311 to the beveled face 333*b*, the spring power of the spring 331 forces the pressure ring 332 against the link 334. When the link 334 moved to the border area of the notch 321*c* of the frequency modulation wheel 321, it is immediately forced into the notch 321*c*, thereby causing the frequency modulation wheel 321 and the amplitude modulation wheel 311 to be linked again. At this time, the frequency modulation wheel 321 is rotated with the amplitude modulation wheel 311 to tilt the bottom rail 123 and the slats 121. When the link 334 moved to the other beveled face 333*c*, the beveled face 333*c* forces the link 334 away from the frequency modulation wheel 321 (see FIG. 11) to disconnect the amplitude modulation wheel 311 from the frequency modulation wheel 321. At this time, the transmission shaft 22 continuously rotates the amplitude modulation wheel 311 to let off the amplitude modulation lift cord 313 and to release the slats 121 without changing the tilting angle of the slats 121.

With respect to the tilting of the slats 121, the operation is described hereinafter. At first, the user operates the signal transmitter 23 to transmit a slat tilting control signal to the signal receiver 24. Upon receipt of the control signal, the signal receiver 24 immediately drives the motor 21 to rotate the transmission shaft 22 and the amplitude modulation wheel 311, and to further forces the link 334 into engagement with the amplitude modulation wheel 311 and the frequency modulation wheel 321, permitting synchronous rotation of the frequency modulation wheel 321 with the amplitude modulation wheel 311 to let off the frequency modulation lift cord 322 and to further control the tilting angle of the slats 121. In actual practice, it is not necessary to tilt the slats 121 at a wide angle, therefore the angle of rotation of the frequency modulation wheel 311 can be limited within a limited range. According to the present preferred embodiment, the frequency modulation wheel 321 is rotatable with the amplitude modulation wheel 311 within about 180°. The stop block 333 limits the angle of rotation of the frequency modulation wheel 311. When the slats 121 tilted to the desired angle, the motor 21 is stopped. (during the aforesaid slat angle tilting control operation, the amount of upward or downward movement of the bottom rail 11 due to rotation of the amplitude modulation wheel 311 is insignificant, without affecting the reliability of the operation).

Figure 15:
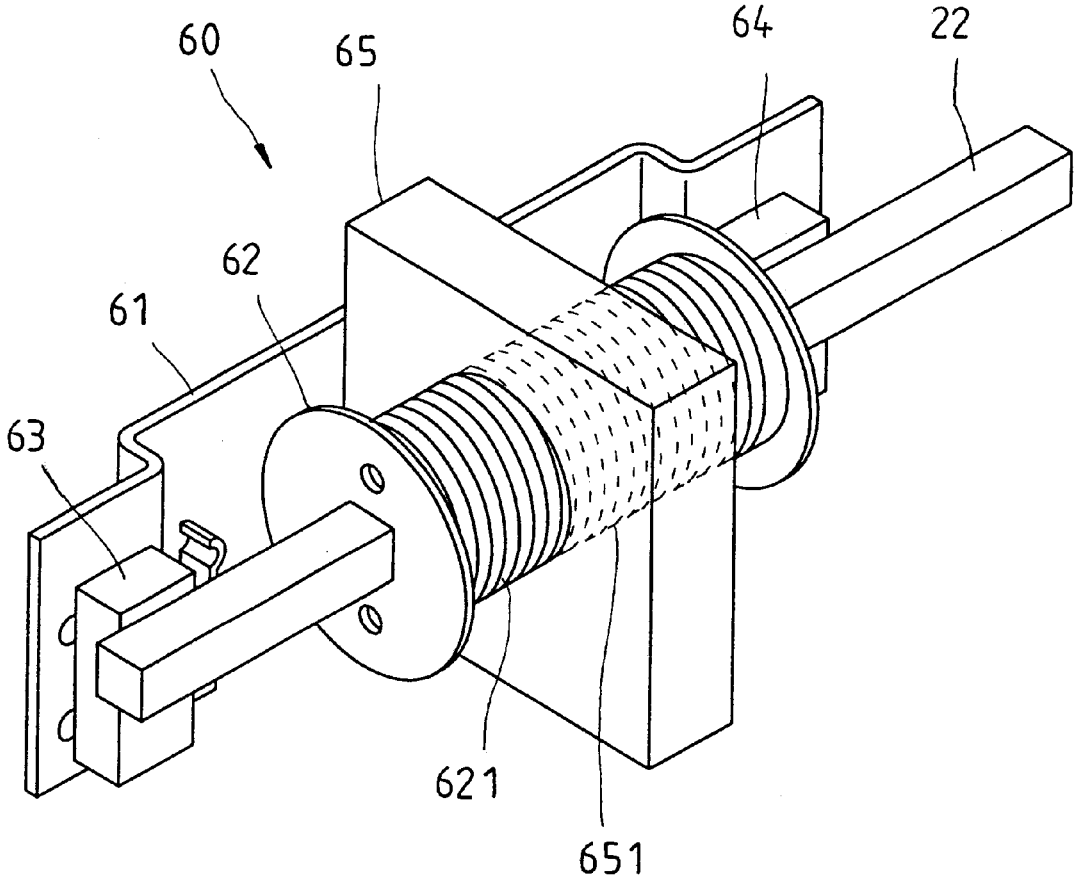
FIG. 15 is a perspective view in an enlarged scale of the detector shown in FIG. 1.
Figure 16:
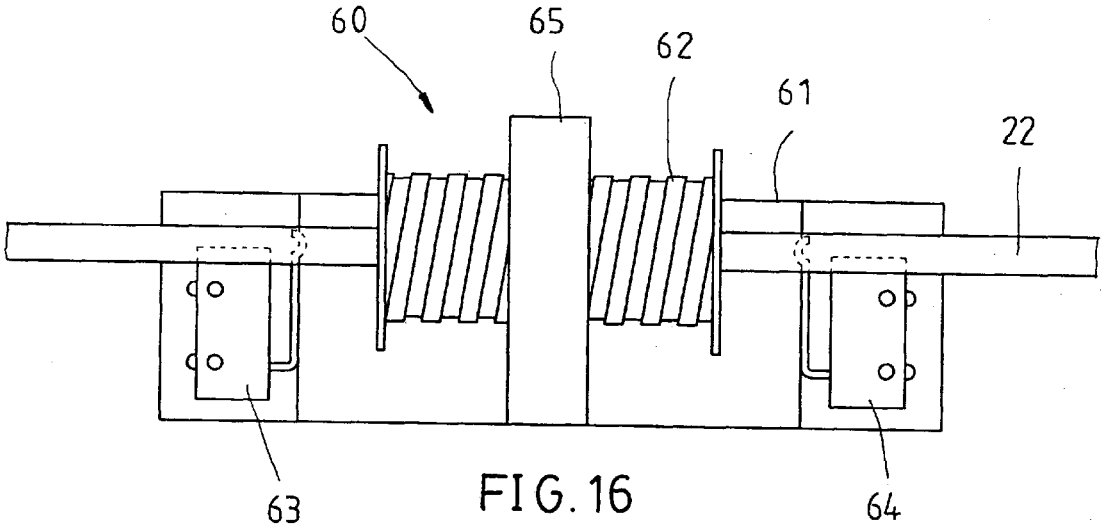
FIGS. 16~18 are schematic drawings showing the action of the detector according to the present invention.
Figure 17:
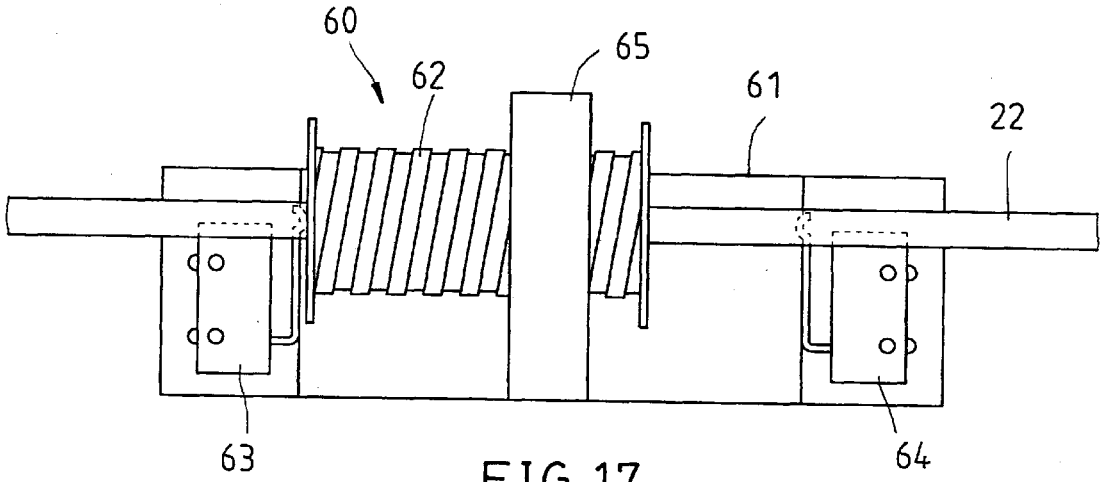
Figure 18:
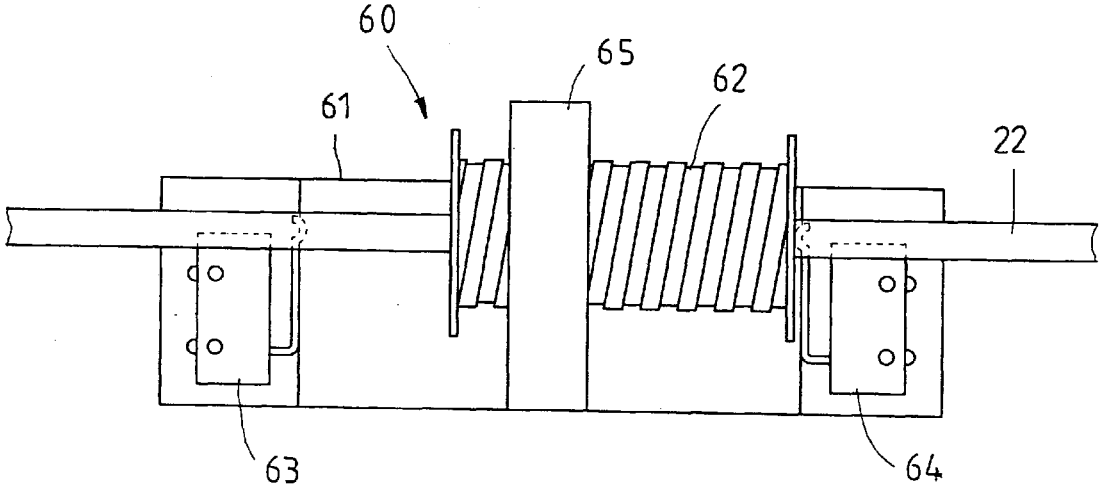

Referring to FIG. 1 and FIGS. 15 and 18, the screw transmission mechanism 100 further comprises a detector 60 installed in the middle of the transmission shaft 22. When the slats 121 moved to the upper limit or lower limit position, the detector 60 is induced to stop the motor 21. According to the present preferred embodiment, the detector 60 comprises a mounting plate 61, a wheel 62, two limit switches 63;64, and a locating block 65. The mounting plate 61 is fixedly fastened to the peripheral wall of the holding chamber 111 of the headrail 11. The locating block 65 is fixedly mounted inside the holding chamber 111 of the headrail 11. having a center screw hole 651. The wheel 62 is coupled to the transmission shaft 22 for synchronous rotation, having an outer thread 621 threaded into the center screw hole 651 of the locating block 65. Rotation of the transmission shaft 22 causes synchronous rotation of the wheel 62 with the transmission shaft 22 and axial movement of the wheel 62 in the locating block 65. The limit switches 63;64 are respectively mounted on the mounting plate 61 at two sides relative to the wheel 62 (in such positions where the wheel 62 touches one limit switch 63 or 64 when the slats 121 moved to the upper limit or lower limit position), and electrically connected to the motor 21. When the slats 121 moved to the upper or lower limit position, the wheel 62 touches one limit switch 63 or 64, thereby causing the limit switch 63 or 64 to cut off power supply from the motor 21.

The structure and function of the present invention are well understood from the aforesaid detailed description. The advantages of the present invention are outlined hereinafter.

1. Slat lifting and tilting dual-control function:

The link serves as clutch means to couple the amplitude modulation wheel, which controls lifting of the slats, and the frequency modulation wheel, which controls tilting of the slats, enabling the amplitude modulation wheel and the frequency modulation wheel to be driven by same driving source to lift or tilt the slats.

2. Single drive source and compact size:

Because the link serves as clutch means to couple the amplitude modulation wheel and the frequency modulation wheel, one single driving source is sufficient to drive the amplitude modulation wheel and the frequency modulation wheel. Therefore, the invention is compact and inexpensive, and requires less installation space.

3. Durable mechanical design:

Because the screw transmission mechanism is provided with a detector, the motor is immediately stopped when the slats moved to the upper or lower limit position, preventing damage to the parts of the mechanism.

What the invention claimed is:

1. A screw transmission mechanism mounted in a Venetian blind for controlling lifting of slats and bottom rail of the Venetian blind and tilting of slats of the Venetian blind, comprising at least one cord roll-up unit and a driving unit adapted to drive said at least one cord roll-up unit, wherein said at least one cord roll-up unit each comprises:

an amplitude modulation set, said amplitude modulation set comprising a support, an amplitude modulation life cord connected to the slats and bottom rail of the Venetian blind and adapted to lift and lower the slats and bottom rail of the Venetian blind, and an amplitude modulation wheel threaded into said support and coupled to said driving unit for free rotation and axial movement relative to said support to roll up and let off said amplitude modulation life cord upon operation of said driving unit, said amplitude modulation wheel comprising a longitudinal groove;

a frequency modulation set, said frequency modulation set comprising a frequency modulation lift cord adapted to tilt the slats of the Venetian blind and a frequency modulation wheel sleeved onto said amplitude modulation wheel and adapted to roll up and let off said frequency modulation lift cord, said frequency modulation wheel comprising a notch; and a linkage, said linkage comprising a link mounted in the groove of said amplitude modulation wheel and the notch of said frequency modulation wheel to couple said frequency modulation wheel to s aid amplitude modulation wheel for synchronous rotation, and a stop block adapted to limit the angle of rotation of said frequency modulation wheel and to force said link away from said frequency modulation wheel when said amplitude modulation wheel is rotated to a predetermined position.

2. The screw transmission mechanism as claimed in claim 1, wherein said driving unit comprises a reversible motor, a transmission shaft coupled between said reversible motor and said amplitude modulation wheel and driven by said reversible motor to rotate said amplitude modulation wheel, such transmission shaft having a non-circular cross section fitted into a non-circular axial center through hole of said amplitude modulation wheel, a signal transmitter adapted to transmit control signal, a signal receiver adapted to receive control signal from said signal transmitter and to control operation of said reversible motor subject to received control signal.

3. The screw transmission mechanism as claimed in claim 2, wherein said signal transmitter is a remote controller.

4. The screw transmission mechanism as claimed in claim 2, wherein said signal transmitter is a wired controller.

5. The screw transmission mechanism as claimed in claim 1, wherein said linkage further comprises a spring sleeved onto said amplitude modulation wheel and stopped between said support and said frequency modulation wheel.

6. The screw transmission mechanism as claimed in claim 5, wherein said linkage further comprises a pressure ring sleeved onto said amplitude modulation wheel and stopped between said spring and said frequency modulation wheel.

7. The screw transmission mechanism as claimed in claim 1, wherein said stop block is fixedly fastened to said support, comprising two beveled faces disposed at two sides of said link and adapted to separate said link from said frequency modulation wheel when said link is moved with said frequency modulation wheel in one direction to one of said beveled faces.

8. The screw transmission mechanism as claimed in claim 1, wherein said linkage further comprises a limiter fixedly fastened to said stop block to stop said frequency modulation wheel from falling out of said amplitude modulation wheel.

9. The screw transmission mechanism as claimed in claim 6, wherein said support comprises a stepped center through hole formed of a recessed hole and a through hole through the center of said recessed hole, and an inner thread extended around the through hole, said recessed hole having a diameter greater than the through hole of said stepped center through hole; said amplitude modulation wheel comprises an outer thread extended around the periphery thereof and threaded into the inner thread of said support.

10. The screw transmission mechanism as claimed in claim 2, further comprising a detector adapted to cut off power supply from said reversible motor when the slats of the Venetian blind are lifted or lowered to the upper limit or lower limit position.

11. The screw transmission mechanism as claimed in claim 10, wherein said detector comprises a mounting plate fixedly mounted in the Venetian blind, a locating block fixedly supported on said mounting plate, a wheel supported in said locating block and coupled to said driving unit for rotation and axial movement upon operation of said driving unit, and two limit switches disposed at two sides in an axial displacement path of the wheel of said detector and electrically connected to said driving unit and adapted to cut off power supply from said driving unit when touched by the wheel of said detector.

12. The screw transmission mechanism as claimed in claim 2, wherein said linkage further comprises a spring sleeved onto said amplitude modulation wheel and stopped between said support and said frequency modulation wheel.

13. The screw transmission mechanism as claimed in claim 12, wherein said linkage further comprises a pressure ring sleeved onto said amplitude modulation wheel and stopped between said spring and said frequency modulation wheel.

14. The screw transmission mechanism as claimed in claim 2, wherein said stop block is fixedly fastened to said support, comprising two beveled faces disposed at two sides of said link and adapted to separate said link from said frequency modulation wheel when said link is moved with said frequency modulation wheel in one direction to one of said beveled faces.

15. The screw transmission mechanism as claimed in claim 2, wherein said linkage further comprises a limiter fixedly fastened to said stop block to stop said frequency modulation wheel from falling out of said amplitude modulation wheel.

* * * * *